US011369213B2

(12) United States Patent
Breen et al.

(10) Patent No.: US 11,369,213 B2
(45) Date of Patent: Jun. 28, 2022

(54) MULTI-FUNCTION INFANT SUPPORT APPARATUS AND METHOD OF USING THE SAME

(71) Applicant: RAHOO BABY, LLC, Scituate, MA (US)

(72) Inventors: Matthew P. Breen, Scituate, MA (US); Erica L. Costa, Scituate, MA (US)

(73) Assignee: RAHOO BABY, LLC, Scituate, MA (US)

( * ) Notice: Subject to any disclaimer, the term of this patent is extended or adjusted under 35 U.S.C. 154(b) by 167 days.

(21) Appl. No.: 16/674,776

(22) Filed: Nov. 5, 2019

(65) Prior Publication Data

US 2020/0138203 A1 May 7, 2020

Related U.S. Application Data

(60) Provisional application No. 62/756,540, filed on Nov. 6, 2018.

(51) Int. Cl.
*A47D 13/08* (2006.01)
*A47D 15/00* (2006.01)

(52) U.S. Cl.
CPC ..... *A47D 13/083* (2013.01); *A47D 15/008* (2013.01)

(58) Field of Classification Search
CPC ..... A47D 13/083; A47D 15/008; A47D 13/08
USPC ..... 5/655
See application file for complete search history.

(56) References Cited

U.S. PATENT DOCUMENTS 4,667,356 A * 5/1987 Holmquist ..... A47C 27/086 5/603
4,907,306 A 3/1990 Nakaji
5,279,237 A * 1/1994 Alivizatos ..... A47K 3/001 112/475.05
5,546,620 A * 8/1996 Matthews ..... A47D 13/08 5/639

(Continued)

FOREIGN PATENT DOCUMENTS

CN 305541489 1/2020
CN 306089897 1/2020

OTHER PUBLICATIONS

Website www.pbteen.com/products/superstudy-lapdesk/?cm_src=AutoRel, "Superstudy Lapdesk" Copyright 2019, Williams Sonoma, Inc., 4 pgs.

(Continued)

*Primary Examiner* — Myles A Throop
(74) *Attorney, Agent, or Firm* — Brooks Kushman, P.C.

(57) ABSTRACT

A multipurpose support apparatus for an infant is disclosed that includes a rigid planar member having a head end, an intermediate portion and a foot end. The head end and foot end each have a rounded outer edge and the intermediate portion includes right and left sides that have curved concave edges. The edges define the outer periphery of the rigid planar member. A mat following the contour of the rigid planar member is adapted to receive the rigid planar member to be removable from the rigid planar member. A removable cover encloses a flexible container that in turn encloses bean-shaped pellets, or compressible foam filler material. The support apparatus may be used for "Tummy Time" exercises, as an infant lounger, or a breast-feeding support.

19 Claims, 5 Drawing Sheets

(56) References Cited

U.S. PATENT DOCUMENTS 5,551,109 A * 9/1996 Tingley ..... A47D 13/02 128/870
5,588,445 A * 12/1996 Obaidi ..... A47D 13/04 128/846
5,675,853 A * 10/1997 Linge ..... A47D 15/008 5/655
5,813,066 A * 9/1998 Gebhard ..... A47D 15/008 5/424
D443,686 S 6/2001 Gonzalez
D481,247 S 10/2003 Roberts et al.
D484,560 S 12/2003 Lin
6,708,356 B1 * 3/2004 LaValle ..... A47D 15/008 128/872
6,857,150 B2 2/2005 Matthews Brown et al.
D544,061 S 6/2007 Kuchler
D552,244 S 10/2007 Tinsley
7,832,036 B2 * 11/2010 Littlehorn ..... A47C 16/00 5/655
9,032,572 B1 * 5/2015 Leach ..... A47D 15/003 5/655
D766,393 S 9/2016 Lau
D779,008 S 2/2017 Osimo
D833,162 S 11/2018 Schnermann
D848,763 S 5/2019 Potter
D860,367 S 9/2019 Barrett et al.
D861,816 S 10/2019 Hsu et al.
D862,117 S 10/2019 Zanki et al.
D862,623 S 10/2019 Hsu et al.
D903,350 S 12/2020 Zhou
D903,351 S 12/2020 Zhou
D904,056 S 12/2020 Schnermann
D906,704 S 1/2021 Cui et al.
D916,479 S 4/2021 Zeng
2005/0015883 A1 * 1/2005 Bartley ..... A47D 13/083 5/655
2005/0125902 A1 * 6/2005 Matthews Brown .... A47D 5/00 5/655
2005/0278854 A1 * 12/2005 Taricani ..... A47D 13/08 5/655
2007/0192961 A1 * 8/2007 Tidwell ..... A47D 13/08 5/655
2007/0271703 A1 * 11/2007 Matthews Brown ..... A47D 15/003 5/636
2009/0031500 A1 * 2/2009 Daly ..... A47D 15/008 5/655
2012/0174321 A1 * 7/2012 Haye ..... A47D 15/005 5/655
2013/0091633 A1 * 4/2013 Garofalo ..... A47D 15/005 5/655
2015/0101125 A1 * 4/2015 Fang ..... A47D 13/083 5/655
2020/0138203 A1 5/2020 Breen et al.

OTHER PUBLICATIONS

Website www.shop-orthopedics.com/Posture_Rite_Lap_Desk_p/nc94110.htm?st-t=adwords&vt-k=&vt-mt=&vt-ap=1o19&gclid=EAIaIQobChMI15D2uM3e2wIV01mGCh2hvAx1EAQYEyABEgLpS_D_BwE, "North Coast Medical & Rehabilitation Products", Copyright 2019 Shop-Orthopedics.com, 5 pgs.

Google search: "Baby Support Apparatus" [site visited May 6, 2021]: https://www.google.com/search?q=BABY +SUPPORT +APPARATUS&sxsrf= ALeKk03y295FiepftoPXoFw2mgHTmjrTEw:162027 4424653 &source=Inms&tbm=isch&sa=X&ved=2ahUKEwifmJTM-mLTwAhVBMIkFHWLbAmwQ_AUoAXoECAEQAw&biw=1200 &bih=1777 (Year: 2021).

Google search: "infant support pillow" [site visited May 6, 2021]: https://www.google.com/search?g=infant+support+pillow&sxsrf= ALeKk03Jx2uwBX4i9Y9HeBfqjVK0dQuPcw:1620274329158&source=Inms&tbm=isch&sa=X&ved=2ahUKEwjkuc-emLTwAhWXGVkFHQ9IC20Q_AUoAnoECAEQBA&biw=1200 &bih=1777 (Year:2021).

Google search: "baby support pillow" [site visited May 6, 2021]: https://www .google.com/search?q=baby+support+pillow&sxsrf= ALeKk0 15EeQIe 1 wrvgkACr T7GBf Aj5pVNw:162027 4631043 &source=Inms&tbm=isch&sa=X&ved= 2ahUKEwiFMiumbTwAhUxEIkFHYuZB_gQ_AUoAnoECAEQBA &biw=1200&bih=1777 (Year:2021).

Mestron Portable Baby bed Support Pillow, earliest pictured review May 25, 2020, [online], [site visited May 4, 2021]. Available from Internet, URL:https://www.amazon.com/Mestron-Portable-Baby-Bed-Positioning/dp/B088JTG2TD/ref=cm_cr_arp_d_product_top?ie=UTF8> (Year: 2020).

* cited by examiner

MULTI-FUNCTION INFANT SUPPORT APPARATUS AND METHOD OF USING THE SAME

RELATED APPLICATION

This application claims the benefit of previously filed provisional application No. 62/756,540 filed Nov. 6, 2018 the disclosure of which is hereby incorporated by reference.

TECHNICAL FIELD

The present invention relates to a support apparatus for infant development exercises, resting and a nursing aid.

BACKGROUND

With regards to infant development, the importance of "tummy time," or the time a child spends on their stomach, is well documented in the literature. With the onset of the "back to sleep" campaign in 1994, the incidence of Sudden Infant Death Syndrome (SIDS) has reduced greatly. Adversely, because of this push for "back to sleep," babies are spending less time on their stomachs and "tummy time" is becoming an even greater challenge for both babies and caregivers. In addition, the incidence of plagiocephaly, or a flattened head, has risen significantly.

Placing a child on the floor or a piece of furniture for "tummy time" causes the baby to feel abandoned. Caregivers need to get down on the floor to soothe their infants during "tummy time."

An alternative is for a caregiver to recline and then place the baby on their chest (chest-to-chest), thus offering "tummy time" in a way that makes the child feel safe and comforted by the caregiver's closeness. The problem however, is that this does not offer an even, firm surface. Chest-to-chest also fails to elevate the infant high enough off of the caregiver's chest to allow the infant to see his or her caregiver's entire face. Other "tummy time" positional strategies exist, but none seem to successfully allow for comfortable, prolonged, and effective "tummy time."

Although other products have been invented to improve the quality and ease of "tummy time," all of them continue to be floor/furniture based. Presently there is no solution allowing an infant to complete "tummy time" on a firm surface while also atop the caregiver's chest to allow for face-to-face time. There is also no solution for caregivers needing to get on the floor to engage their child during traditional "tummy time." In addition, currently there is no product designed with two distinct features to address plagiocephaly: 1) target the problem of prolonged exposure to a hard surface in the supine position, 2) make "tummy time" easier to carry out.

A further need when caring for an infant is the need to support the infant when resting on their back in a safe and secure manner that does not exacerbate plagiocephaly. In addition, there is a need for an infant support apparatus to support the infant when breastfeeding. With the number of products required to care for an infant, an apparatus that can fulfill multiple needs can reduce costs and save space.

This disclosure is directed to solving the above problems and other problems as summarized below.

SUMMARY

The present invention seeks to provide a solution to these problems by providing a product designed to offer an even, firm surface that allows the infant to engage in "tummy time" on top of the caregiver, while visually exploring his or her caregiver's entire face. The infant can now feel comforted and soothed by the caregiver (i.e. not abandoned on the floor/furniture). This product also provides caregivers an alternative to getting on the floor with their baby for "tummy time." In addition to offering a firm, weight bearing side for "tummy time," when flipped over, this product becomes a baby lounger that reduces the pressure on the back of the baby's head (to assist with concerns related to plagiocephaly).

According to one aspect of this disclosure, an apparatus is disclosed for supporting an infant. The apparatus includes an hourglass shaped board, a mat adapted to be removably fastened around the hourglass shaped board on a top portion of the apparatus, an outer cover that is attached to one side of the mat, and a bean bag insert received in the outer cover and forming a bottom portion of the apparatus.

According to other optional aspects of this disclosure, the bean bag insert may be contoured to hold a head end of the board higher than the foot end of the board. A handle may be attached to one end of the board and attached to the mat for carrying the apparatus. A pillow and the top side of the mat may be provided with a plurality of fasteners for detachably connecting the pillow to the mat. A belt may be attached to the board that extends over and across the mat for restraining an infant on the mat. A stabilizing belt may be attached to the board that extends under and across the outer cover to stabilize the apparatus when strapped to a caregiver. At least one fastener may be provided for connecting the outer cover to the one side of the mat.

According to another aspect of this disclosure, a multipurpose support apparatus for an infant is disclosed that includes a rigid planar member having a head end, an intermediate portion and a foot end. The head end and foot end have convexly curved outer edges and the intermediate portion includes right and left side edges that are concavely curved edges. The edges of the head end the foot end and the side edges define the outer periphery of the rigid planar member. A mat following the contour of the rigid planar member is adapted to receive the rigid planar member and is removable from the rigid planar member. A cover is attached to one side of the mat that encloses a flexible container containing filler material. The flexible container may be removable from the cover to allow the cover to be washed or the flexible container may be permanently contained within the cover and washed with the cover and mat.

According to other aspects of the multipurpose support apparatus, the rigid planar member may be a rigid board formed of a polymer material, the mat may be made of a first textile fabric, and the cover may be made of a second textile fabric. The intermediate portion may be 28 cm or between 20 and 30 cm in width at the narrowest point between the right and left sides. The head end may have a maximum width of 31 cm or between 23 and 36 cm and the foot end may have a maximum width of 41 cm or between 28 and 46 cm. A handle may be attached at the head end of the rigid planar member and attached to the mat for carrying the apparatus. The flexible container and cover may be 15 cm or between 13 and 17 cm in height at the head end and may be 8 cm or between 6 and 10 cm in height at the foot end to hold an infant's head above their feet when the infant lies on the mat for exercise in a prone position and when the infant lies on the cover in a supine position. The angle of inclination of the mat is about 15° or between 10° and 30° when the bottom portion of the apparatus is lying on the floor.

The multipurpose support apparatus may further comprise a safety belt attached to the board and extending over and across the mat for restraining an infant on the mat, and a stabilizing belt attached to the board and extending under and across the outer cover to stabilize the apparatus when strapped to a caregiver. The apparatus may further comprise a pillow, and a plurality of fasteners provided on the pillow and a top side of the mat for detachably connecting the pillow to the mat.

According to another aspect of this disclosure, a method is disclosed for supporting an infant on the torso of a caregiver. According to the method, an exercise apparatus is provided that includes an hourglass shaped board having a mat removably fastened around the hourglass shaped board on a top portion of the apparatus, and an outer cover enclosing a filled bag-like insert on a bottom portion of the apparatus. The bottom portion of the exercise apparatus is positioned on a front torso of the caregiver. The infant is then positioned on the top portion of the exercise apparatus. The caregiver can then play with the infant being in a prone position.

According to other aspect of this disclosure as it relates to the method, the infant may be secured to the top portion of the apparatus with a belt. The method may further comprise securing the bottom portion to the caregiver and the infant to the top portion of the apparatus with a stabilizing belt.

The method may be used for a multiple functions by inverting the exercise apparatus placing the top portion of the exercise apparatus on a supporting surface and positioning the infant in a supine position on the bottom portion to use the apparatus as a lounger or to use the apparatus to support the infant when breastfeeding.

The above aspects of this disclosure and other aspects will be described below with reference to the attached drawings.

DETAILED DESCRIPTION

Figure 1:
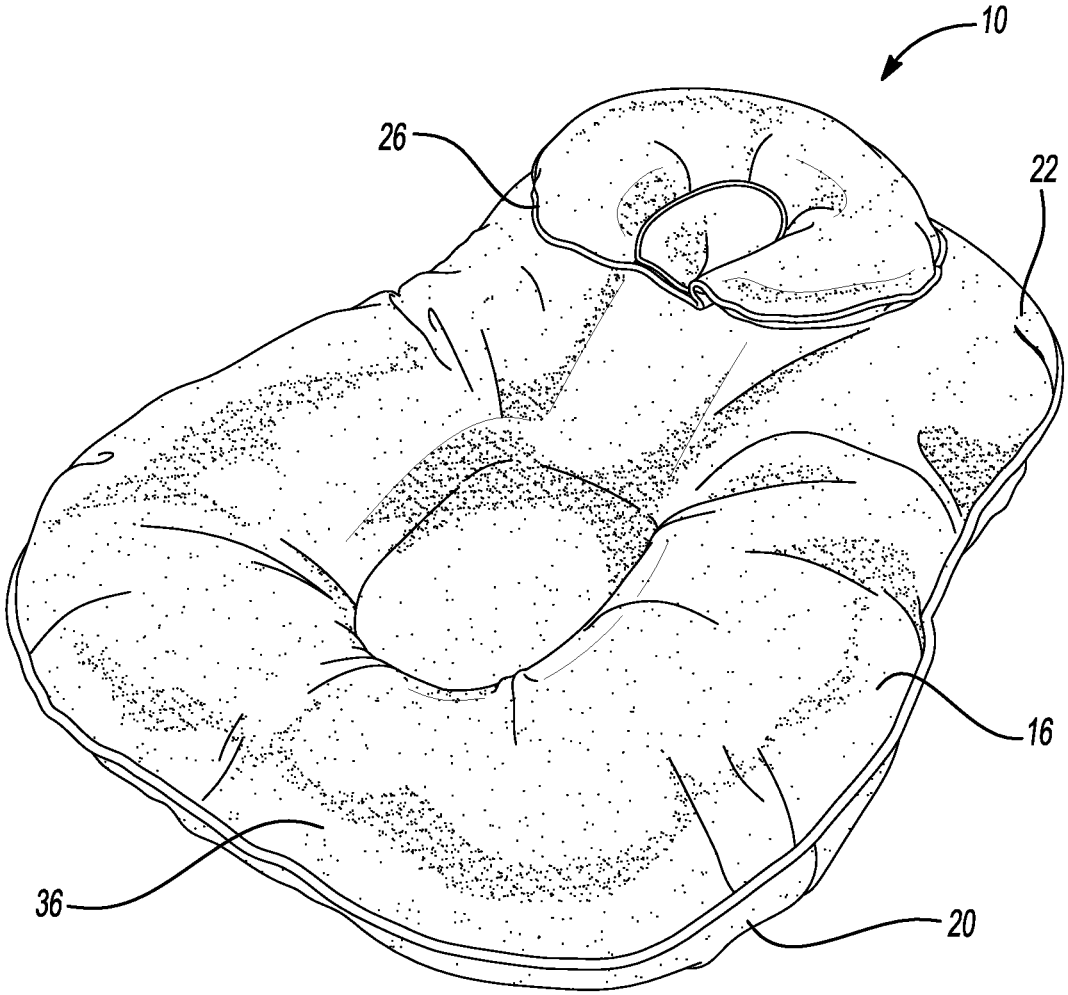
FIG. 1 is a perspective view of a multi-function infant support apparatus made according to one aspect of this disclosure.
Figure 3:
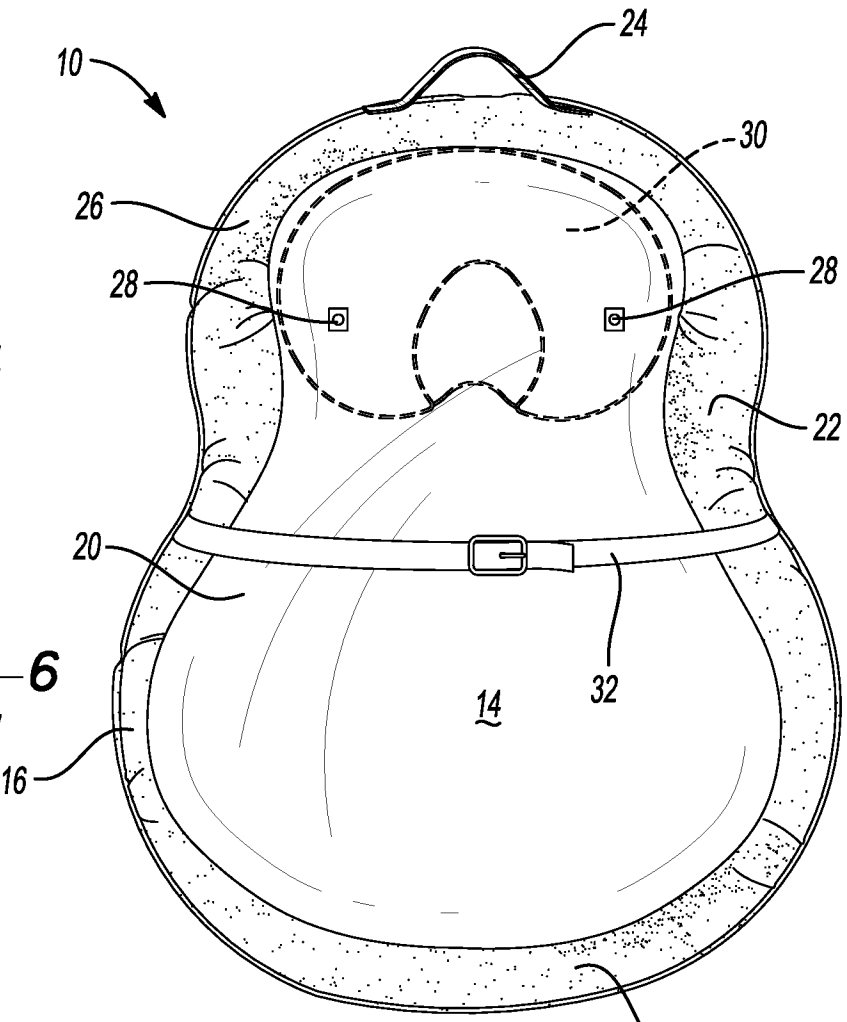
FIG. 3 is a top plan view of the multi-function infant support apparatus of FIG. 1.
Figure 2:
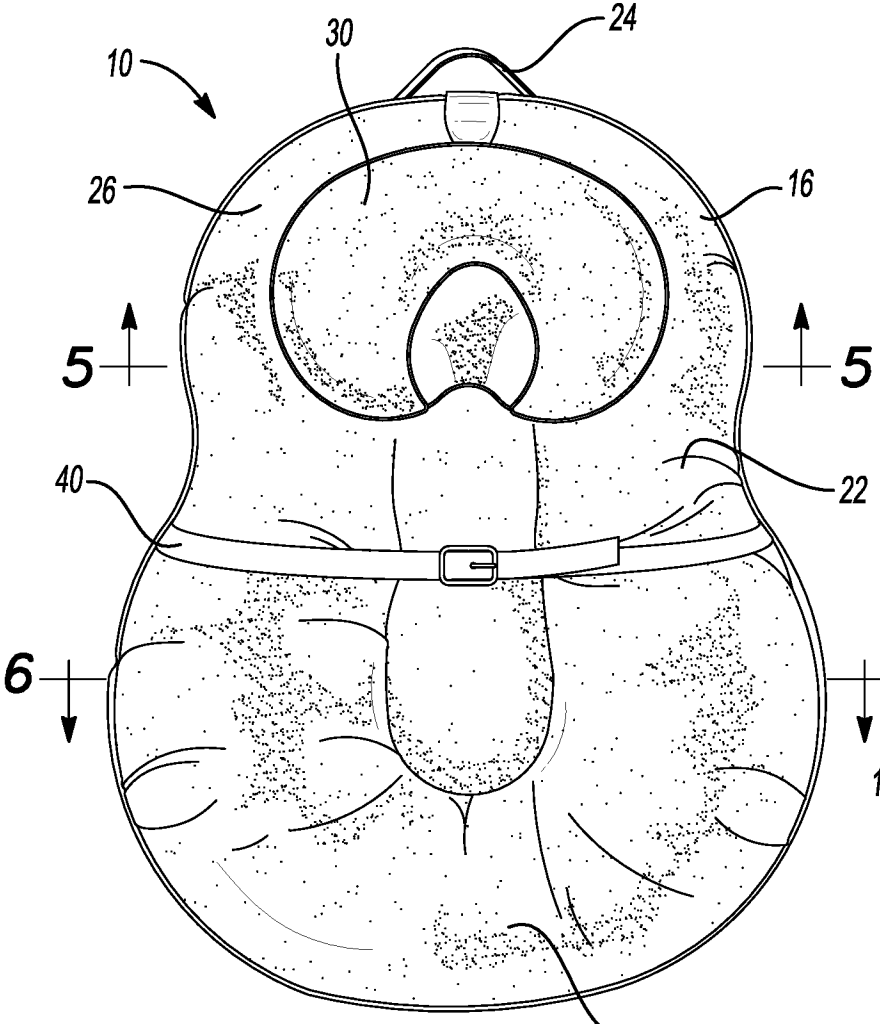
FIG. 2 is a bottom plan view of the multi-function infant support apparatus of FIG. 1.

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Referring to FIGS. 1-4, the top side of apparatus 10 includes a firm board 12, which is covered by an outer mat layer 14 that allows the baby to lie on top of in the prone position. Attached to the underside of the board 12 (shown in FIGS. 5 and 6) and an outer mat layer 14 is an outer cover 16 enclosing a bean bag 18 (shown in FIGS. 5 and 6) containing filler material. The term "bean bag" should be construed to be a filled bag-like enclosure that is filled with pellets, foam fill pieces, or a molded foam member. The outer cover 16 has a soft surface that potentially serves three purposes: 1) stabilizing the board 12 as the product rests on a caregiver's torso during "tummy time," 2) serving as a baby lounger for the baby to recline on top of in the supine position when apparatus 10 is flipped over, and 3) functioning as a support during breastfeeding.

The apparatus 10 consists of a "top" part 20 and a "bottom" part 22. The "top" part includes a firm, hour-glass like shaped board 12, covered by a soft, washable, outer mat layer 14 that is formed around the board 12. The outer mat layer 14 can in-part be comprised of a crinkle material that is known to be used in other baby products. The board 12 is removable, with the outer mat layer 14 being adapted to fasten and unfasten around the board 12 for ease of washing the outer mat 14.

The hourglass shaped board has a head end has a maximum width of 31 cm or between 23 and 36 cm. The foot end 36 has a maximum width of 41 cm or between 28 and 46 cm. The intermediate portion has a width of 28 cm or between 20 and 30 cm at the narrowest point between the right and left sides.

A handle 24 may be provided proximate the top, or head end 26, of the board 12 that facilitates carrying or transport of the apparatus 10. The handle 24 may be a separate part sewn to the apparatus or may be integrally formed with the apparatus 10. Fasteners 28 may be provided on the outer mat layer 14 on the top side of the board 12 to facilitate attaching and detaching of a small pillow 30 to assist the child in "tummy time." A belt 32 is detachably attached to the board 12 for securing the infant on the board. The underside of the "top" part 20 may, as an option, have fasteners 34 underneath the top part 20 to facilitate attaching and detaching to the "bottom" part 22 from the top part 20.

The "bottom" part 22 encloses the filled bag-like enclosure 18 (shown in FIGS. 5 and 6) inside an outer cover 16 that may or may not be detachably connected to the "top" part 20 via the fasteners 34. The bottom part 22 is inclined with the height of the head end in the center having a height "H" including the height of the "top" part and the recess having a minimum height "h" including the height of the "top" part at the longitudinal centerline of the apparatus. The dashed line in FIG. 4 generally denotes the contour at the longitudinal centerline but it should be understood that the dashed line is only approximate due to the compressibility of the apparatus 10. The height "H" being greater than the height "h" to provide the desired inclined relationship. The apparatus 10 is inclined to hold an infant's head above their feet when the infant lies on the mat 14 for exercise in a prone position and when the infant lies on the cover 16 in a supine position.

The flexible container 18 and cover 16 are 15 cm or between 13 and 17 cm in height at the head end 26 at a center line of the apparatus 10 extending from the head end 26 to the foot end 36 and 8 or between 6 and 10 cm in height at the foot end 36 at the center line. The approximate distance between the measured heights at the head end and the foot end is about 18 cm. The angle of inclination of the mat is about 15° or between 10° and 30° when the bottom portion of the apparatus is lying on the floor.

The outer cover 16 has a zipper 38 that allows for removing the filled bag-like enclosure 18 to allow for washing the outer cover 16 and subsequently reinserting the filled bag-like enclosure 18. The filled bag-like enclosure 18 is disposed under the board 12 to hold the board 12 at an incline in the "tummy time" exercise position. The incline of the filled bag-like enclosure 18 also holds the infant's head above their feet in the lounger orientation with the apparatus 10 inverted. There is also a stabilizing belt 40 that may be fastened around a caregiver to stabilize the product during "tummy time."

The filled bag-like enclosure 18 may be a textile or fabric enclosure 42 filled with bean-shaped pellets 44 or beans, or alternatively, may be filled with a compressible polymer foam pieces or with a compressible molded foam pillow. If made as a molded foam pillow, the bag-like enclosure 42 may be eliminated, and the foam pillow may be received directly in the outer cover 16. The fabric enclosure 42 may also be eliminated and the foam pieces may be enclosed only by the outer cover 16.

Figure 4:
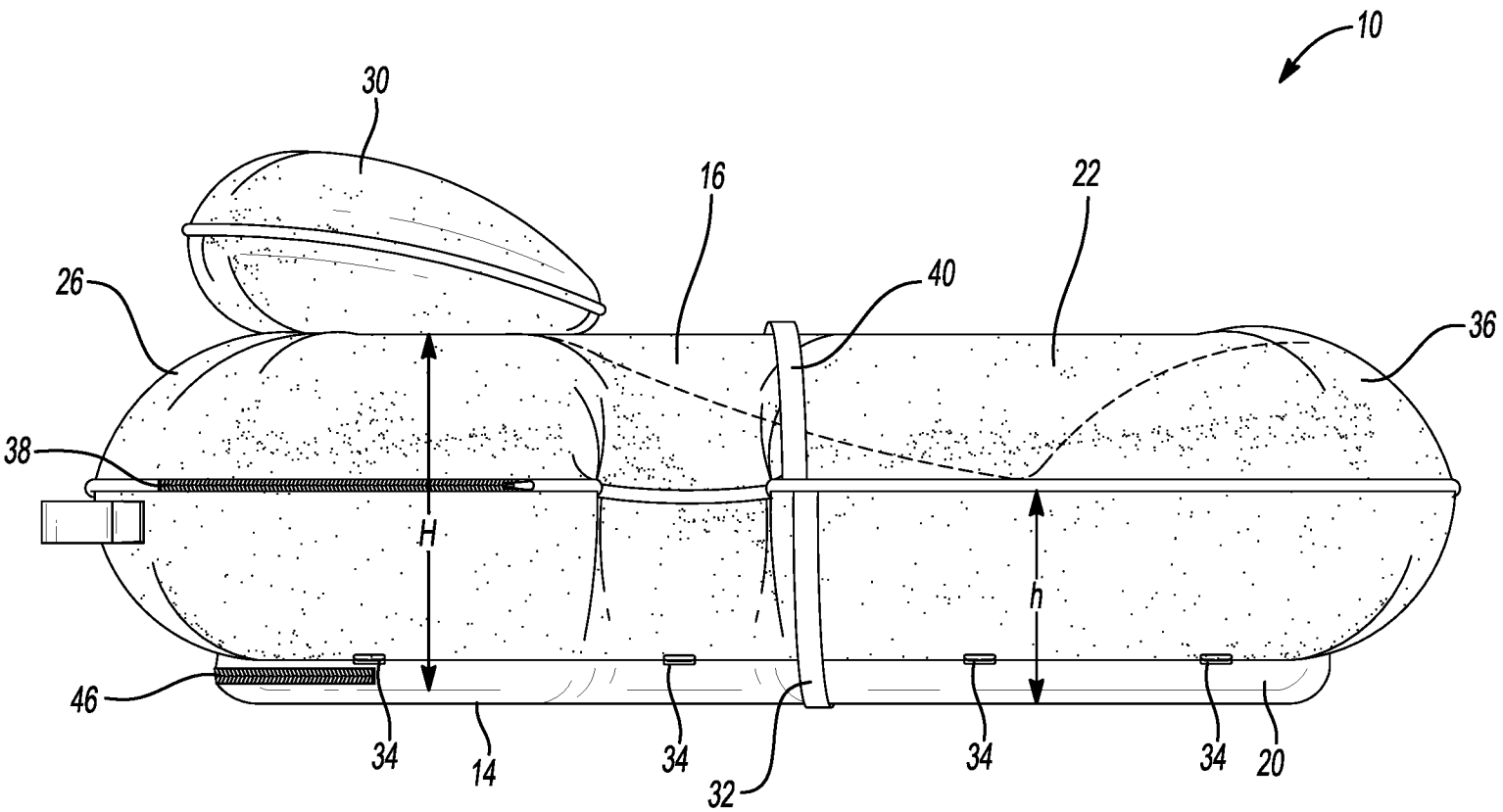
FIG. 4 is a side elevation view of the multi-function infant support apparatus of FIG. 1.
Figure 5:
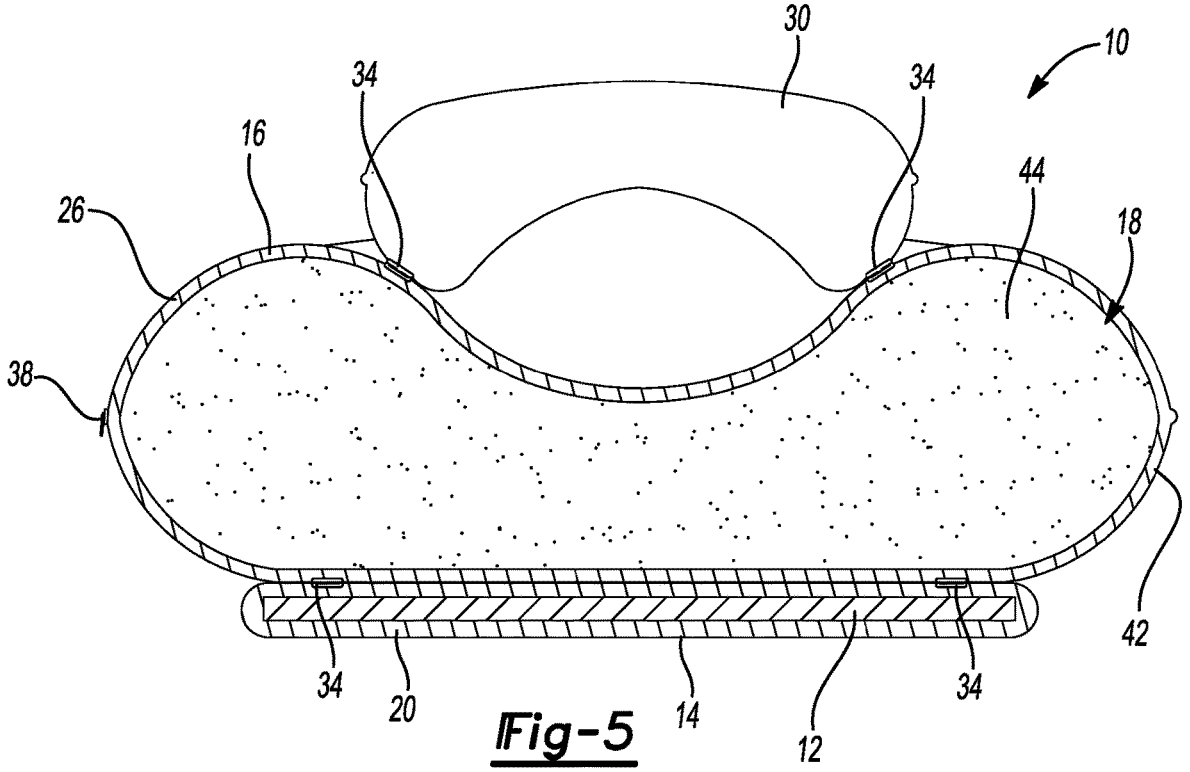
FIG. 5 is a cross-section view taken along the line 5-5 in FIG. 2.
Figure 6:
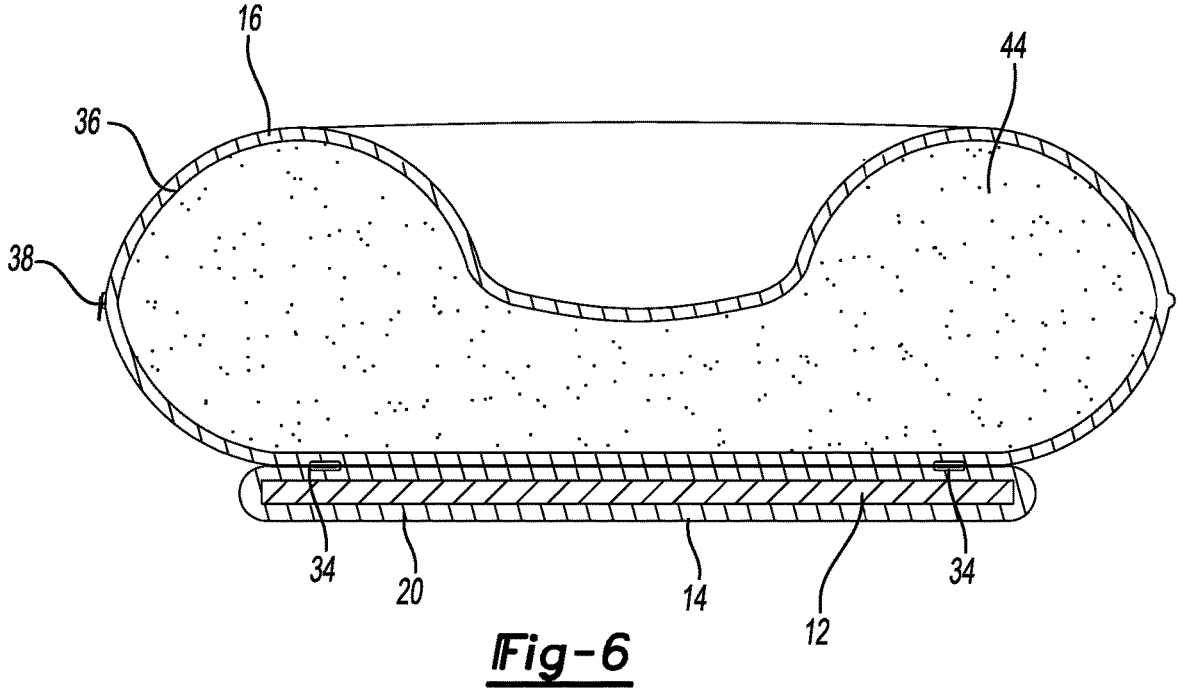
FIG. 6 is a cross-section view taken along the line 6-6 in FIG. 2.

Referring to FIGS. 4, 5 and 6, the cross section of the apparatus 10 is shown in the head end 26 and foot end 36, respectively. The apparatus 10 is shown inverted with the top part 20 below the bottom part 22 in the infant lounging orientation.

The apparatus 10 includes the top part 20 including the board 12 enclosed within the outer mat layer 14. The board 12 may be a rigid polymeric foam material such as a polyurethane foam that maintains a planar configuration with only limited deflection (less than 5 cm) when an infant weighing less than 7 kilograms is placed on the board with the board being supported on its ends. Alternatively, the board may be a Masonite™ board, a solid polymer sheet, or the like.

The outer mat layer 14 that encloses the board 12 may be made in-whole or in-part of crinkle material (a polymer sheet that makes a crinkling sound when touched) and that is waterproof and washable. A zipper 46 may be provided in the outer mat layer 14 to facilitate removing the board from the outer mat layer 14. Alternatively, the outer mat layer could have a plurality of buttons or Velcro™ strips instead of the zipper 46.

The bottom part 22 includes the outer cover 16 that encloses the filled bag-like enclosure 18 made of a flexible fabric or plastic material referred to as the enclosure 42. The enclosure 42 protects compressible filler material 44 that may be bean-shaped pellets, loose polymer foam fill, or a molded polymer foam pillow. The outer cover 16 may include a zipper 38 for an opening that may be used to remove the enclosure 42 with the filler material 44.

A pillow 30 may be attached to the outer cover 16 of the bottom part 22 as shown in FIG. 5 by fasteners 28 that may be snaps, buttons or Velcro® strips. The same pillow 30 may be attached to either the bottom part 22 or the top part 20 or different pillows may be used for the top part 20 and the bottom part 22.

The top part 20 is attached to the bottom part 22. In an alternative embodiment, the top part 20 and bottom part 22 may be attached to each other by a plurality of fasteners 34. One example of an appropriate fastener 34 is a two-part snap fastener. Alternatively, the fasteners may be buttons, Velcro® strips, or the like. In this way, either or both of the outer mat layer 14 or the outer cover 16 may be separately washed as needed.

Figure 7:
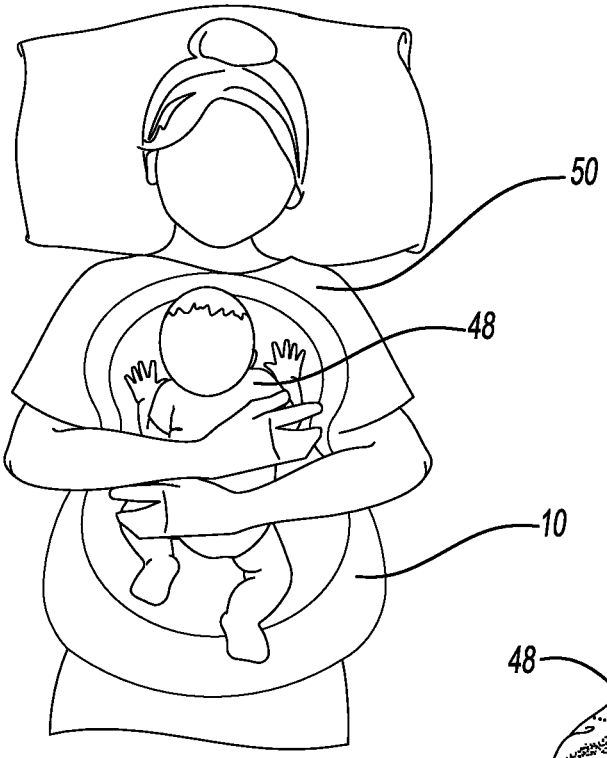
FIG. 7 is a top plan view of the multi-function infant support apparatus showing the apparatus being used for tummy time exercising.

Referring to FIG. 7, the apparatus 10 is shown with an infant 48 and a caregiver 50 performing the function of "tummy time" exercise. The infant 48 is in a prone position secured with the belt 32. The caregiver 50 is shown with the apparatus 10 and infant 50 supported on the caregiver's torso. The caregiver may be secured to the apparatus 10 by the stabilizing belt 40 shown in FIG. 2.

Figure 8:
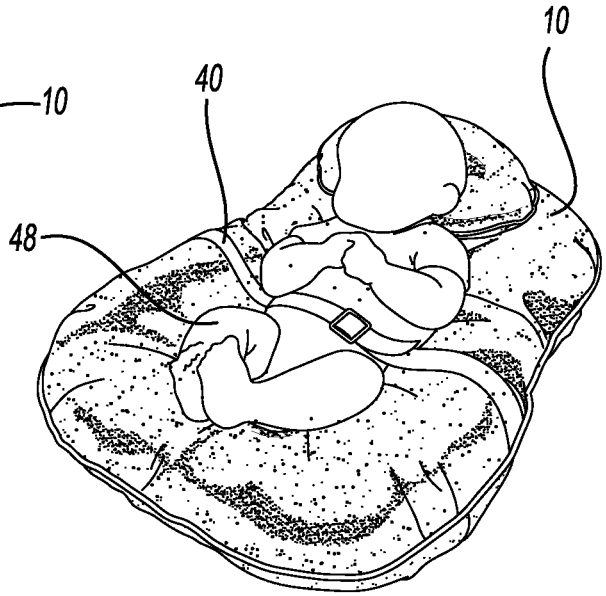
FIG. 8 is a top plan view of the multi-function infant support apparatus showing the apparatus being used as a lounger.

Referring to FIG. 8, the apparatus 10 is shown with the infant 48 performing the function of providing a lounger for the infant. In this mode the apparatus may be supported on the floor or another horizontal supporting surface. The infant 48 is in a supine position and secured with the belt 32.

Figure 9:
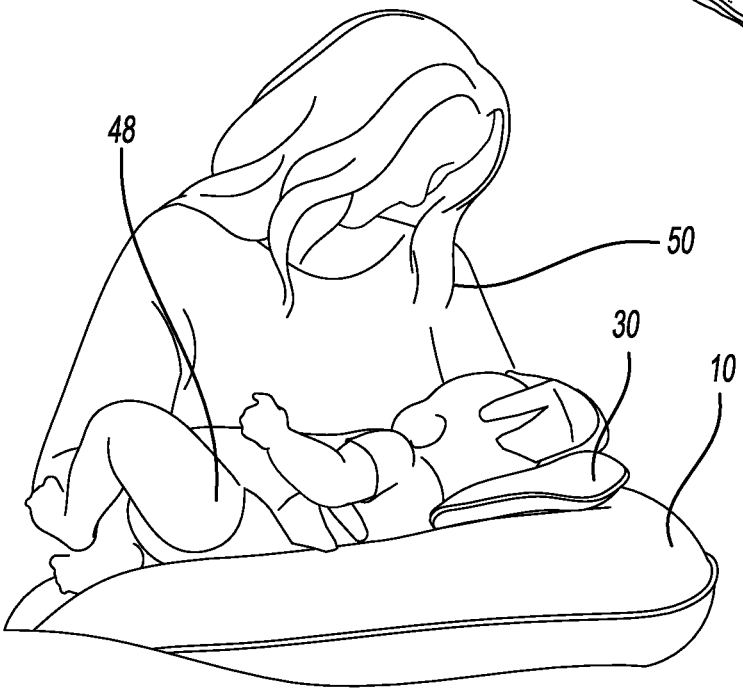
FIG. 9 is a top plan view of the multi-function infant support apparatus showing the apparatus being used as a support when breast-feeding.

Referring to FIG. 9, the apparatus 10 is shown with an infant 48 breast-feeding with the infant being supported on the apparatus with the caregiver sitting down and the head of the in supported on the pillow 30.

The embodiments described above are specific examples that do not describe all possible forms of the disclosure. The features of the illustrated embodiments may be combined to form further embodiments of the disclosed concepts. The words used in the specification are words of description rather than limitation. The scope of the following claims is broader than the specifically disclosed embodiments and also includes modifications of the illustrated embodiments.

What is claimed is:

1. An apparatus for supporting an infant comprising:

an hourglass shaped board;

a mat adapted to be removably fastened around the hourglass shaped board is disposed on a top portion of the apparatus;

an outer cover is provided on one side of the mat, the outer cover is attached to one side of the mat; and a filler insert is received in the outer cover and forms a bottom portion of the apparatus that is adapted to receive a portion of a torso of a person with a head end of the board being higher than a foot end of the board in a tummy time orientation, wherein the filler insert is contoured to hold a head end of the board at a height H when the apparatus is inverted to support the infant in a supine position, wherein a recess is defined between a head end of the insert and a foot end of the insert, wherein the recess has a minimum height h when the apparatus is inverted, and wherein H is greater than h along a longitudinal centerline of the apparatus, and wherein the cover and filler insert have a cover intermediate portion that includes a cover right side and a cover left side that have concavely curved cover edges that are each adapted to receive an arm of the person to facilitate holding the infant on the board in the supine position.

2. The apparatus of claim 1 further comprising:

a handle disposed at one end of the board and attached to the mat for carrying the apparatus.

3. The apparatus of claim 1 further comprising:

a pillow; and a plurality of fasteners provided on the pillow and the outer cover of the bottom portion for detachably connecting the pillow to the mat.

4. The apparatus of claim 1 further comprising:

a belt attached to the board and extending over and across the mat for restraining an infant on the mat.

5. The apparatus of claim 1 further comprising:

a stabilizing belt attached to the board and extending under and across the outer cover to stabilize the apparatus when strapped to a caregiver.

6. The apparatus of claim 1 wherein the mat is a flexible fabric enclosure that further comprises:

at least one fastener connecting the outer cover to the one side of the mat.

7. A multipurpose support apparatus comprising:

a rigid planar member having a head end, an intermediate portion and a foot end, wherein the head end and foot end each have a convexly curved outer edge and the intermediate portion includes a right side and a left side that have concavely curved edges;

a mat having mat head end and a mat foot end that each have a convexly curved mat outer edge and the intermediate portion includes a mat right side and a mat left side that have concavely curved mat edges following a contour of the rigid planar member that receives the rigid planar member and is removable from the rigid planar member; and a cover attached to one side of the mat that contains a filler, wherein the cover and filler have a cover head end and a cover foot end that each have a convexly curved cover outer edge and a cover intermediate portion that includes a cover right side and a cover left side that have concavely curved cover edges following the contour of the rigid planar member, and wherein the cover and filler define a recess between the cover head end, the cover foot end, the cover right side, and the cover left side, wherein the recess is not open through the cover and filler to the mat, and wherein the recess has a recess height at the lowest point thereof that is less than a head end height of the cover.

8. The multipurpose support apparatus of claim 7 wherein the rigid planar member is a rigid board formed of a polymer material, the mat is made of a first fabric, and the cover is made of a second fabric.

9. The multipurpose support apparatus of claim 7 wherein the intermediate portion is between 20 and 30 centimeters in width at a narrowest point between the right side and left side.

10. The multipurpose support apparatus of claim 7 wherein the head end has a maximum width of between 23 and 36 centimeters and the foot end has a maximum width of between 28 and 46 centimeters.

11. The multipurpose support apparatus of claim 7 further comprising:

a handle disposed at the head end of the rigid planar member and attached to the mat for carrying the apparatus.

12. The multipurpose support apparatus of claim 7 wherein the cover containing the filler material is between 13 and 17 centimeters in height at the head end at a center line of the apparatus extending from the head end to the foot end and between 6 and 10 centimeters in height at the foot end at the center line to hold an infant's head above their feet when an infant lies on the mat for exercise in a prone position and when the infant lies on the cover in a supine position.

13. The multipurpose support apparatus of claim 7 further comprising:

a safety belt attached to the rigid planar member and extending over and across the mat for restraining an infant on the mat; and a stabilizing belt attached to the rigid planar member and extending under and across the mat to stabilize the apparatus when strapped to a caregiver.

14. The multipurpose support apparatus of claim 7 further comprising:

a pillow; and a plurality of fasteners provided on the pillow and the cover for detachably connecting the pillow to the cover.

15. A method of supporting an infant on a torso of a caregiver comprising:

providing an exercise apparatus including an hourglass shaped board having a mat fastened around the hourglass shaped board on a top portion of the apparatus, and an hourglass shaped outer cover enclosing filler material on a bottom portion of the apparatus, wherein the hourglass shaped outer cover and filler material define a recess between a cover head end, a cover foot end, a cover right side, and a cover left side, wherein the recess is not open through to the mat, wherein the cover and filler insert, the hourglass shaped board, and mat have intermediate portions that include a right side and a left side that have concavely curved outer edges;

positioning the recess defined by the bottom portion of the exercise apparatus on a front torso of the caregiver with a head end of the exercise apparatus elevated relative to a foot end of the exercise apparatus;

positioning the infant on the top portion of the exercise apparatus with a head of the infant elevated relative to a body of the infant; and playing with the infant while the infant is in a prone position facing the caregiver, and with each arm of the caregiver being disposed around the concavely curved outer edges to facilitate holding the infant on the top portion of the apparatus.

16. The method of claim 15 further comprising: securing the infant to the top portion of the apparatus with a belt.

17. The method of claim 15 further comprising:

securing the bottom portion to the caregiver and the infant to the top portion of the apparatus with a stabilizing belt.

18. The method of claim 15 further comprising:

inverting the exercise apparatus by placing the top portion of the exercise apparatus on a supporting surface; and positioning the head of the infant on the head end of the exercise apparatus at a height H with the infant in a supine position and with the body of the infant partially disposed in the recess, wherein the recess has a height h at a lowest point on a longitudinal centerline that is less than the height H of the head end.

19. The method of claim 15 further comprising:

inverting the exercise apparatus by placing the top portion of the exercise apparatus on a supporting surface and positioning the infant on the bottom portion while breastfeeding the infant.

* * * * *